United States Patent [19]

Pitman et al.

[11] Patent Number: 4,459,786

[45] Date of Patent: Jul. 17, 1984

[54] LONGITUDINALLY BOWED TRANSVERSELY POLYGONAL BOOM FOR CRANES AND THE LIKE

[75] Inventors: Raymond F. Pitman, Prairie Village; Robert M. Bornowski, Olathe, both of Kans.

[73] Assignee: RO Corporation, Olathe, Kans.

[21] Appl. No.: 315,308

[22] Filed: Oct. 27, 1981

[51] Int. Cl.[3] ..... B66C 23/62; E04H 12/18

[52] U.S. Cl. ..... 52/115; 52/118; 52/731

[58] Field of Search ..... 52/115, 118, 731, 745, 52/632, 734; 212/144, 55

[56] References Cited

U.S. PATENT DOCUMENTS

| | | | |
|---|---|---|---|
| 3,837,502 | 9/1974 | Hornagold | 52/115 X |
| 3,985,234 | 10/1976 | Jouffray | 52/118 X |
| 3,992,836 | 11/1976 | Mitra | 52/731 X |
| 4,038,794 | 8/1977 | Young . | |
| 4,171,597 | 10/1979 | Lester | 52/632 X |

FOREIGN PATENT DOCUMENTS

| | | | |
|---|---|---|---|
| 272618 | 7/1969 | Austria | 52/731 |
| 746955 | 3/1956 | United Kingdom | 52/632 |
| 800780 | 9/1958 | United Kingdom | 52/115 |
| 2078821 | 1/1982 | United Kingdom | 52/118 |

OTHER PUBLICATIONS

*Cranes Today,* Cole Achieves Dramatic Rise in Liftability with Tele Boom Reappraisal, Feb. 1980.

*Primary Examiner*—J. Karl Bell

*Attorney, Agent, or Firm*—Schmidt, Johnson, Hovey & Williams

[57] ABSTRACT

An improved, high strength extensible crane boom is provided which has a plurality of elongated, tubular, telescopically interfitted, longitudinally bowed, prestressed boom sections, along with a low cost method of fabricating the respective boom sections. Each boom section preferably includes an elongated upper plate having a channel structure welded to the underside thereof to form a polygonal body; permanent bowing of the body is accomplished as an incident to the welding sequence by virtue of asymmetrical heating and subsequent cooling of the metallic boom components. The boom sections are advantageously pentagonal in cross section, and the separate sides of the channel structures are simultaneously welded to the upper plates to evenly heat the plates and minimize torsional distortion of the sections.

13 Claims, 17 Drawing Figures

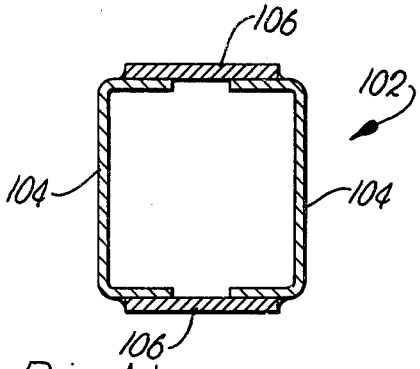
Prior Art
Fig. 1.
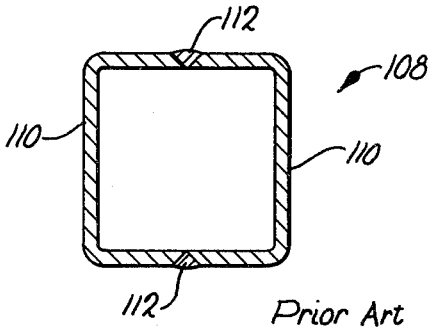
Prior Art
Fig. 2.
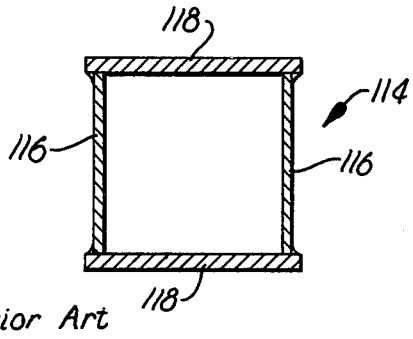
Prior Art
Fig. 3.
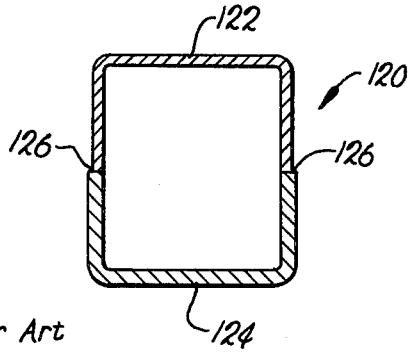
Prior Art
Fig. 4.
Fig. 5.
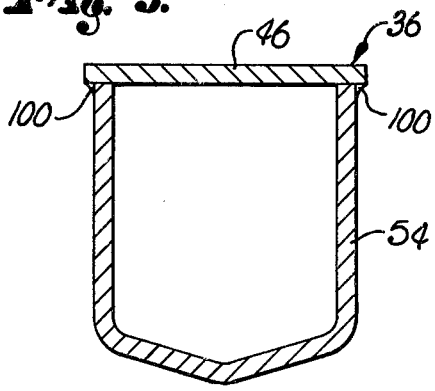
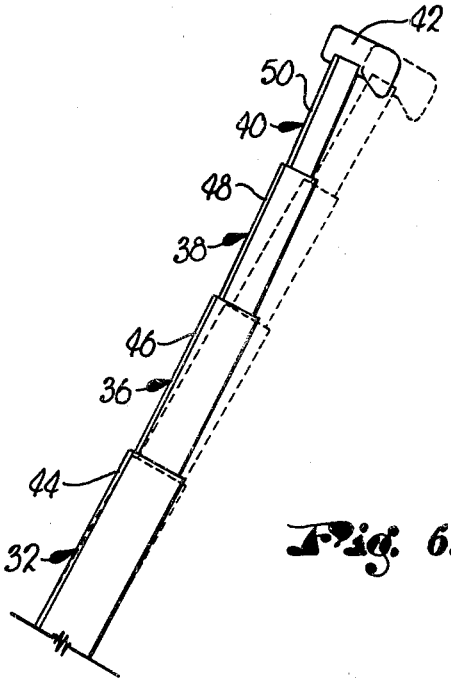
Fig. 6.

Fig. 7.
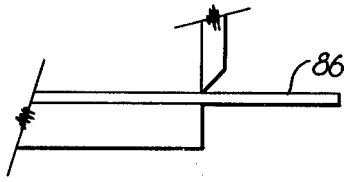
Fig. 8.
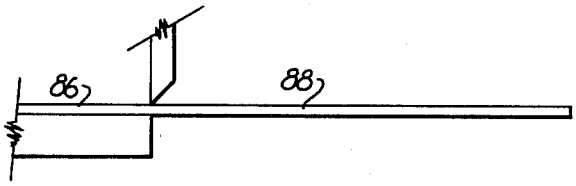
Fig. 9.
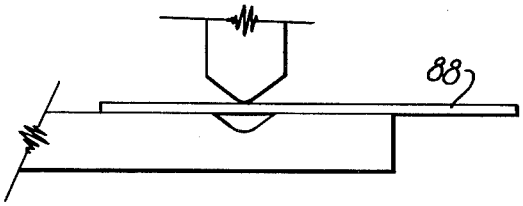
Fig. 10.
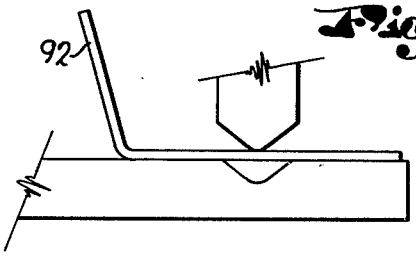
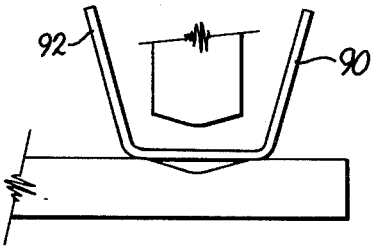
Fig. 11.
Fig. 12.
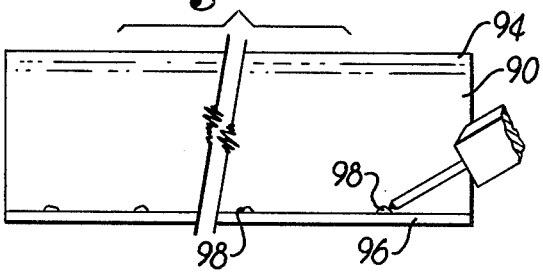
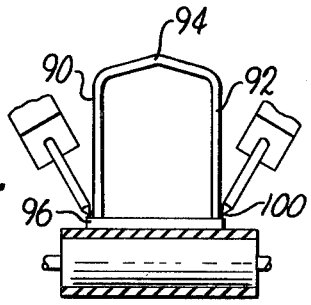
Fig. 13.
Fig. 14.
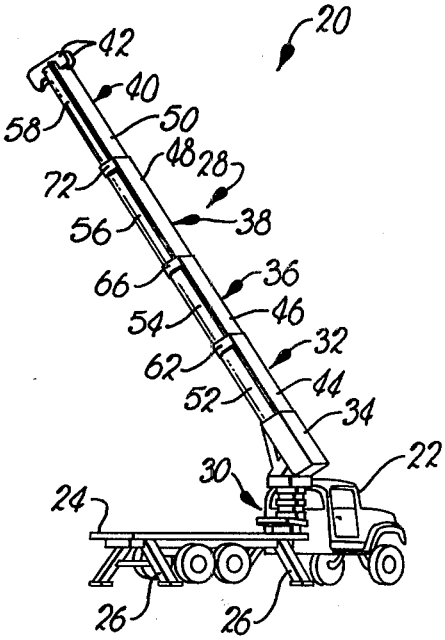

LONGITUDINALLY BOWED TRANSVERSELY POLYGONAL BOOM FOR CRANES AND THE LIKE

BACKGROUND OF THE INVENTION

1. Field of the Invention

The present invention is concerned with an improved boom for cranes or the like, along with a novel method for fabrication thereof which is low in cost and yields a finished boom having improved strength and reach capabilities as compared with conventional designs. More particularly, it is concerned with such a boom which includes a plurality of telescopically interfitted boom sections, wherein each boom section comprises an elongated, tubular, metallic body configured to present an arcuate bow therein extending along the length of the body.

2. Description of the Prior Art

Multiple section extensible booms are conventionally employed on truck mounted or other types of mobile cranes. Generally speaking, these booms include a plurality of elongated, telescopically interfitted, tubular sections which are selectively extensible and retractable by means of a hydraulic piston and cylinder assembly located within the boom sections.

Boom sections of the type described above have been provided in a wide variety of shapes and sizes. For example, square, rectangular, trapezoidal and octagonal in cross section boom sections have heretofore been proposed. See also U.S. Pat. No. 4,038,794, which describes hexagonal in cross section boom constructions.

Despite the many teachings of various cross sectional shapes and sizes for boom sections, without known exception these units have been constructed to be substantially rectilinear, i.e., without significant longitudinal bends or bows therein. This for the reason that such a construction has heretofore been thought to be inimical to smooth reciprocation of telescopically interfitted sections.

A prime problem with boom sections heretofore available stems from the cost of fabrication thereof. In some instances as many as twelve separate steps have been necessary in the manufacturing process, with the result that cost of boom manufacture has been unduly expensive. At the same time, in order to ensure adequate strength in the boom, manufacturers have tended to employ large quantities of expensive steel, and this has further compounded the problems of cost.

SUMMARY OF THE INVENTION

The present invention provides a greatly improved boom structure made up of individual, telescopically interfitted sections. A prime feature of the boom sections of the invention is that they are of elongated, tubular configuration and are configured to present an arcuate bow therein extending along the length of the section.

In more detail, each boom is preferably designed such that the axis of the arcuate bow therein is transverse to the longitudinal axis of the section, with the extreme ends of the body being vertically spaced from the midpoint of the body between the ends, when the body is horizontally oriented.

Each of the boom sections is preferably polygonal in cross section, and most preferably pentagonal. Only two metallic components are employed in preferred procedures for fabricating the boom sections, i.e., a rectangular, elongated upper plate, and a four-sided channel member welded to the underside of the upper plate.

In preferred manufacturing procedures, the upper plate is placed on a support in an inverted position with the normal underside thereof facing upwardly. The channel member is then placed on the plate and tack welded into position. At this point the channel member is fully welded to the plate, preferably by simultaneously welding the respective end margins of the channel member to the normal plate underside. During the full welding operation, the boom section is subjected to asymmetrical heating and differential expansion relative to the cross section thereof, and as a consequence the section assumes a longitudinally bowed configuration. Upon cooling, the boom shrinks and assumes a final reverse bowed configuration. In the method of the present invention, this differential heating and cooling phenomenon is allowed to occur to achieve heretofore unavailable structural and functional results.

In actual practice, it has been discovered that use of the longitudinally bowed sections of the invention coupled with the boom shape can give a 10 to 20 percent increase in strength over certain prior booms, and moreover the effective height of the boom is measurably greater than conventional units. This stems from the fact that a multiple section boom using the longitudinally bowed sections hereof has a greater resistance to load-induced downward deflection. Therefore, the loaded tip height is greater than with a conventional straight boom by virtue of the fact that the tip is at a greater elevation than with a normal boom before loading.

BRIEF DESCRIPTION OF THE DRAWINGS

FIGS. 1–4 are respectively cross sectional, somewhat schematic illustrations of prior known boom section constructions;

FIG. 5 is a cross sectional view of the preferred boom section construction of the present invention;

FIG. 6 is an elevational view of an extended boom in accordance with the invention, with a conventional boom being illustrated in phantom to depict the increase in effective height gained through use of the boom of the present invention;

FIGS. 7–13 are respectively schematic illustrations of the steps involved in the manufacture of boom sections in accordance with the invention;

FIG. 14 is an elevational view of a truck-mounted boom in accordance with the invention, shown in its extended position;

DESCRIPTION OF THE PREFERRED EMBODIMENTS

Figure 15:
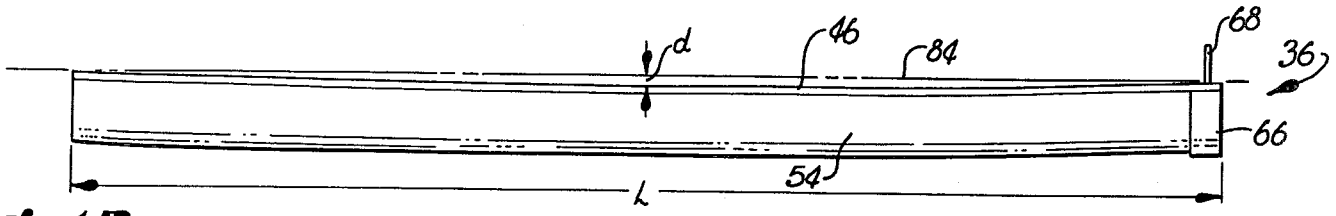
FIG. 15 is a side elevational view of a boom section in accordance with the inventional, with the longitudinal bow therein being exaggerated for purposes of illustration.

Turning now to the drawings, a boom truck 20 is illustrated in FIG. 14. The truck 20 includes the usual truck body 22 having a bed 24 and outriggers 26. A boom broadly referred to by the numeral 28 is pivotally mounted to bed 24 by means of conventional mounting structure 30. Boom 28 includes a lowermost inner section 32 fitted with the usual boom glove 34; an intermediate second section 36 telescoped within section 32; a third intermediate section 38 telescoped within section 36; and a fourth outer or uppermost section 40 telescoped within section 38 and provided with uppermost boom plates 42. Each of the sections 32, 36, 38 and 40 is preferably although not necessarily formed of high strength steel having for example a rated strength of 80,000 psi. Other suitable steels having strengths in the range of 50,000 to 100,000 psi aluminum material can also be used to fabricate the boom for certain applications.

Figure 16:
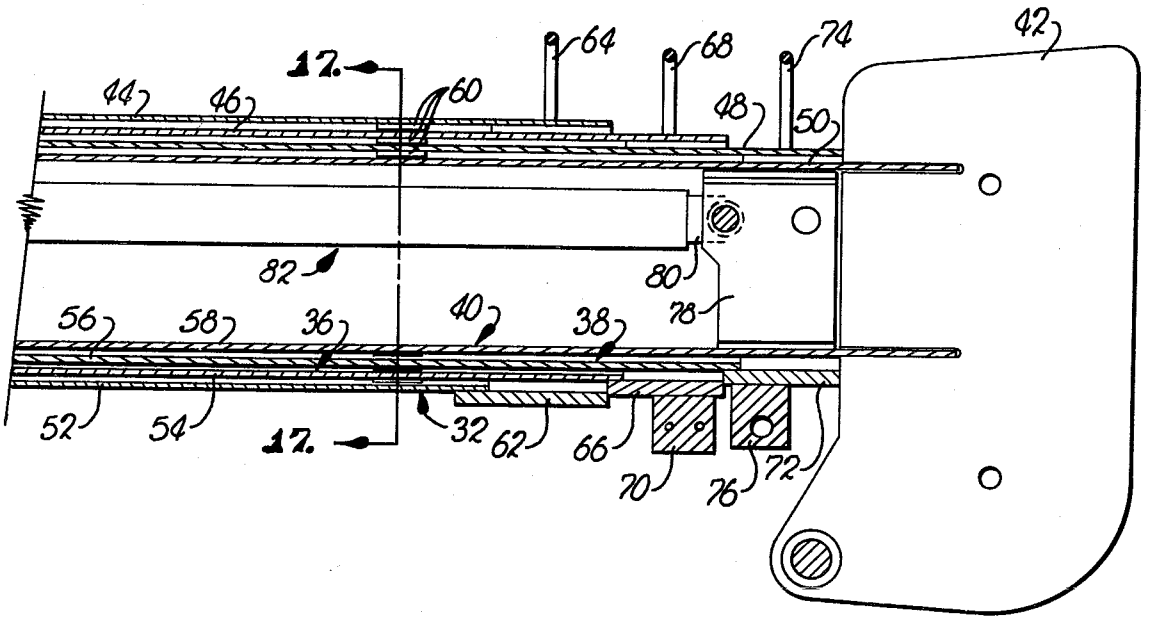
FIG. 16 is a vertical sectional view illustrating the outer end of a retracted, multiple-section boom in accordance with the invention.
Figure 17:
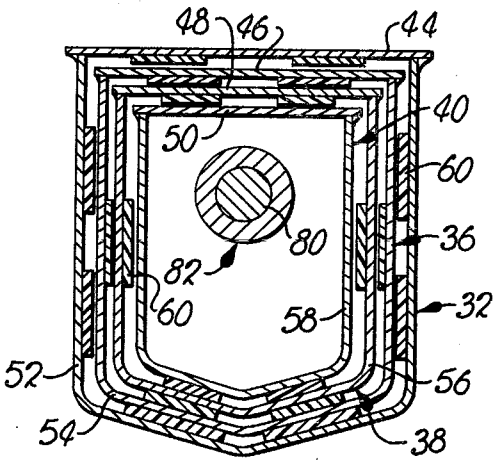
FIG. 17 is a sectional view taken along line 17—17 of FIG. 16 which further illustrates the construction of the preferred boom.

Referring to FIGS. 16 and 17, it will be seen that each of the sections include an elongated, rectangular metallic top plate 44, 46, 48, or 50, along with a somewhat U-shaped channel 52, 54, 56 or 58 welded to the associated top plate. The sections are of progressively smaller effective cross-sectional dimensions and are telescopically interfitted. Reciprocable movement of the sections relative to one another is facilitated by means of anti-friction blocks 60 of synthetic resin material situated between the plates 44–50 and the channels 52–58 of the respective sections.

Referring specifically to FIG. 16, it will be seen that a U-shaped channel tip 62 is welded to the outermost end of boom section 32 in generally conforming relationship to the channel 52 thereof. On the other hand, the top plate 44 of this section is provided with an upstanding rope guide bail 64. In like manner, second section 36 is provided with a U-shaped channel tip 66 and rope guide bail 68. In this instance however, a depending boom lock plate 70 is secured to the underside of channel tip 66. Third section 38 has a U-shaped channel tip 72 affixed to the outermost end thereof, and a rope guide bail 74 secured to the top plate 48 thereof. An apertured boom locking plate 76 is welded to and depends from the underside of channel tip 76. Finally, it will be seen that the respective boom plates 42 are secured to the outermost end of upper section 40. In addition, a mounting block 78 is secured within the section 40 adjacent the plates 42. The piston 80 forming a part of hydraulically actuated piston and cylinder assembly 82 is secured to block 80 so that the respective boom sections can be extended or retracted as desired, as will be readily apparent to those skilled in the art.

As noted above, an essential feature of the boom sections in accordance with the invention is provision of an arcuate bow in the body thereof which extends along the length of the same. Referring specifically to FIG. 15, second section 36 has been illustrated in elevation. This same section is depicted in vertical section in FIG. 5. In any event, it will be seen that the section 36 is provided with an arcuate bow therein which extends along the length of the body of the section. For ease of discussion and for purposes of illustration, a rectilinear reference line 84 has been applied to FIG. 15 which extends between the extreme ends of the section 36. It will be observed in this respect that the ends of the section are vertically spaced above the midpoint of the section between the ends, when the body is horizontally oriented as depicted in FIG. 15. This distance has been labeled "d" on FIG. 15 at the midpoint of the section 36. In addition, the overall length "L" of the section is illustrated by appropriate arrow lines. In practice of the present invention, it has been found that the ratio of the distance "d" to length "L" (d/L) should be in the range of about 0.00075 to about 0.004 and preferably being up to about 0.0038. It will further be understood that the selection of section 36 was made for purposes of illustration only, and that each of the sections 32 and 36–40 are longitudinally bowed in the manner illustrated in FIG. 15, although the ratios of d/L in each case may vary somewhat. Further, it will be appreciated that the FIG. 15 illustration has been exaggerated in terms of the magnitude of the longitudinal bow, in order to clearly illustrate the construction of the section.

In practice, the d to L ratio may be different for inner, intermediate or outer boom sections of a multiple boom crane assembly. The inner base boom for example may have a bow dimension of about $\frac{1}{4}$ inch for a 22 foot longitudinal boom length, the intermediate boom section may have a bow of about $\frac{1}{2}$ inch for the same length boom section and the outer boom section of a three stage boom assembly may have an effective bow of $\frac{3}{4}$ inch for a 22 foot boom length. Of particular note is the fact that the bow in the base boom has more effect on the tip height of the boom assembly when extended and elevated than the bow in the other boom sections even though it has a lesser degree of bowing. The same is true as to the bow in the intermediate boom section relative to the outermost boom section. In a four stage boom assembly, the final effective boom tip height difference is greater than the three feet between the structure of this invention as compared with a standard or conventional straight multiple boom unit. FIG. 6 illustrates the boom 28 in its fully extended position wherein each of the sections 32 and 36–40 are longitudinally bowed in the manner described. For purposes of comparison, a standard boom having rectilinear sections is illustrated in phantom in FIG. 6. In both cases the respective booms employ sections having essentially the same length. However, by virtue of the bowed configuration of the boom sections of the invention, the overall boom 28 has a greater initial effective height than the standard boom. By virtue of the cross sectional shape of the boom and the longitudinal bowing thereof, the boom tip has a significantly higher elevation under load than a conventional straight boom providing a more effective crane under varying use conditions. The upshot of these characteristics is that the boom 28 of the invention provides greater strength characteristics and effective height than is the case in a standard boom crane.

Although boom sections in accordance with the invention can have a variety of lengths, preferably the length should be from about 16 feet retracted length to as much as about 30 feet retracted length. Moreover, the plate and channel sections of the respective booms should be formed of steel having a rated strength of up to about 80,000 psi; above this level, the metal becomes more difficult to weld and shaping thereof can reduce the strength of the metal.

Attention is now directed to FIGS. 7–13 which illustrate the preferred steps involved in fabricating the boom sections hereof. FIGS. 7 and 8 illustrate the steps of shear cutting a plate of steel 86 at two spaced locations in order to form an elongated, rectangular, channel blank 88. FIGS. 9–11 illustrate in schematic form the three breaks or forming operations performed on the blank 88 in order to shape the same and give a generally U-shaped, four-sided channel structure having spaced sidewalls 90, 92 and a peak bottom wall 94. Inasmuch as the shearing and forming operations are conventional, the techniques involved in each of these steps need not be described in complete detail.

FIG. 12 illustrates the initial connection of a rectangular top plate 96, and the previously formed channel structure. Specifically, the plate 96 is placed on a support in an inverted condition with the normal underside thereof facing upwardly. At this point the channel structure is likewise inverted and placed on the plate. A series of spaced tack welds 98 are then employed to initially position the channel structure on the plate.

The next step in the fabrication method involves full welding of the channel structure to the plate 96 to give the weld lines 100. Preferably, this is accomplished by placing the tacked channel and plate construction on a conveyor 95, and passing the construction under and through a two-station welding apparatus to weld the end margins of the sidewalls 90, 92 to the normal underside of plate 96, (see FIG. 13). Alternatively, the boom can be held stationary and the two opposed welding machines moved longitudinally of the length of the boom. In particularly preferred forms, the two elongated, continuous welds are performed simultaneously, as depicted.

During the full welding operation described, the boom section is subjected to significant heating. However, this heating is asymmetrical relative to the cross section of the boom, i.e., more heating occurs at the region of the joint between the plate 96 and the channel structure, as will be readily appreciated from a study of FIG. 13. As a consequence of this asymmetrical heating, the boom section is differentially expanded and initially longitudinally bowed along its length in a vertical direction opposite to that of FIG. 15. After the welding operation is complete, the completed body is allowed to cool. This causes the completed section to differentially shrink and assume the final bowed and prestressed configuration of FIG. 15. During the cooling step, the boom bow reverses its vertical direction relative to the longitudinal axis of the section.

The method of fabrication of the invention provides substantial advantages in terms of cost, as well as giving the improved boom sections described. For example, and referring to FIG. 1, one type of conventional boom section 102 is depicted which includes a pair of opposed channel members 204 interconnected by means of heavy metallic plates 106. Fabrication of this type of boom section requires a total of twelve separate operations (four shears, four breaks, two pairs of tack welds, and two pairs of continuous welds. FIG. 2 depicts another prior boom section 108 formed of two channel members 110 welded together by means of fillet welds 112. This unit likewise requires twelve separate manufacturing operations (four breaks, four bevels, two shears, one pair of tack welds, and one pair of continuous welds). FIG. 3 illustrates yet another boom section construction 114 wherein side plates 116 are welded to thicker top and bottom plates 118. Manufacture of the section 114 requires eight operations (four shears, two pairs of tack welds, two pairs of continuous welds). However, this construction takes the longest time in actual practice, because of the necessity of keeping the four individual parts aligned during the tack up and full welding operation. Manufacture of this unit also requires considerable expensive fixturing, and is therefore objectionable for this reason as well.

FIG. 4 depicts a final type of boom section 120 heretofore available which comprises a pair of welded together channels 122 and 124. This design employs a channel 124 which is considerably thicker than the channel 122, which permits fillet welding as at 126. Manufacturing requires a total of eight operations (two shears, four breaks, one pair of tack welds, one pair of continous welds).

The above is to be contrasted with the present invention which requires the least number of manufacturing steps (seven). Specifically, two shear cutting operations (FIGS. 7–8), three forming or breaking operations (FIGS. 9–11), one paired tack welding operation (FIG. 12), and finally a paired continuous welding operation (FIG. 13) which can be accomplished without costly beveling of any of the structural components.

In sum, significant savings are realized by virtue of the present method of fabrication, as compared with prior techniques. To give but one example, the savings in time as compared with fabrication of boom sections 108 are on the order of 30 to 50 percent. Further, it will be seen that the manufacture of the prior boom sections 102, 108, 114 and 120 does not provide asymmetrical heating during the full welding operation, so that the longitudinal bowing of the sections cannot be accomplished by this means. This is to be contrasted with the present method wherein the important boom section bowing can be accomplished entirely as a consequence of the full welding operation, and further, the extent of bowing can be controlled by speed of the full welding operation, and the extent of asymmetrical heating of the plate and channel structure.

We claim:

1. A boom, comprising:

a plurality of elongated, tubular, telescopically interfitted boom sections, including an extensible, uppermost boom section; and means adjacent the outer end of said uppermost boom section for suspending a load therefrom and as a consequence to impose a downwardly directed stress force on said boom, at least certain of said boom sections in an unstressed condition being longitudinally bowed in an upward direction for rendering the effective height of said boom greater than the effective height of an other wise identical boom having only unbowed boom sections.

2. The boom as set forth in claim 1, one of said certain boom sections comprising an elongated body having an elongated metallic plate and an elongated metallic channel structure, said channel structure being coupled to said plate along the length thereof.

3. The boom as set forth in claim 2, said plate of said one boom section having a first end and a second end, the midpoint of said plate being spaced a distance from a line passing through said plate first end and second end.

4. The boom as set forth in claim 3, the ratio of said distance to the length of said body being up to about 0.0038.

5. The boom as set forth in claim 4, said ratio ranging from about 0.00075 to about 0.004.

6. The boom as set forth in claim 2, said body being polygonal in cross section.

7. The boom as set forth in claim 6, said body being pentagonal in cross-section.

8. The boom as set forth in claim 2, said structure being welded to said plate.

9. The boom as set forth in claim 2, said plate being the normal tension force-absorbing member of the body.

10. The boom as set forth in claim 2, the metal making up said plate and structure having a rated strength of up to about 100,000 psi.

11. The boom as set forth in claim 2, said one boom section having a length of from about 16 to about 30 feet retracted length.

12. The boom as set forth in claim 1, wherein said certain boom sections each have a lower longitudinally extending, transversely V-shaped base portion, said base portions complementally interfitting, one within the next adjacent boom section.

13. The boom as set forth in claim 1, including hydraulic means operatively coupled to said boom for extension and retraction of said telescopically interfitted sections.

* * * * *